US010753659B2

(12) United States Patent
Barjhoux et al.

(10) Patent No.: US 10,753,659 B2
(45) Date of Patent: Aug. 25, 2020

(54) METHOD FOR ADJUSTING A CRYOGENIC REFRIGERATION APPARATUS AND CORRESPONDING APPARATUS

(71) Applicant: L'Air Liquide, Société Anonyme pour l'Etude et l'Exploitation des Procédés Georges Claude, Paris (FR)

(72) Inventors: Pierre Barjhoux, La Tronche (FR); Jean-Marc Bernhardt, La Buisse (FR); Cindy Deschildre, Sassenage (FR); David Grillot, Rives (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 573 days.

(21) Appl. No.: 15/327,498

(22) PCT Filed: Jun. 5, 2015

(86) PCT No.: PCT/FR2015/051492
§ 371 (c)(1),
(2) Date: Jan. 19, 2017

(87) PCT Pub. No.: WO2016/012677
PCT Pub. Date: Jan. 28, 2016

(65) Prior Publication Data

US 2017/0219265 A1 Aug. 3, 2017

(30) Foreign Application Priority Data

Jul. 23, 2014 (FR) ..... 14 57100

(51) Int. Cl.
*F25B 49/02* (2006.01)
*F25J 1/02* (2006.01)
(Continued)

(52) U.S. Cl.
CPC ..... *F25B 49/02* (2013.01); *F25B 1/10* (2013.01); *F25B 9/002* (2013.01); *F25J 1/0065* (2013.01);
(Continued)

(58) Field of Classification Search
CPC .... F25J 1/027–0272; F25J 1/0065; F25J 1/02; F25J 1/0244; F25J 1/0265; F25B 49/02; F25B 1/10; F25B 9/002
(Continued)

(56) References Cited

U.S. PATENT DOCUMENTS 3,167,113 A * 1/1965 Kleiss ..... F25J 3/069 165/293
2014/0238070 A1 8/2014 Bernhardt et al.

FOREIGN PATENT DOCUMENTS

FR 2 954 973 7/2011
WO WO 2013 041789 3/2013

OTHER PUBLICATIONS

Butkevitch et al., Parallel Operation of Cryogenic Units with a Single Steady-State Operated Device, ICEC 14 Proceedings, ICEC Supplement, Cryogenics, 1992, pp. 130-133, vol. 32.
(Continued)

*Primary Examiner* — Joel M Attey
(74) *Attorney, Agent, or Firm* — Elwood L. Haynes

(57) ABSTRACT

The invention relates to a method for adjusting a cryogenic refrigeration apparatus including a plurality of liquefiers/refrigerators arranged in parallel in order to cool a single device. The method includes a step of calculating in real time the dynamic mean value of at least one operating parameter for all the liquefiers/refrigerators. The apparatus controlling in real time the at least one valve for controlling the stream of working gas of at least one liquefier/refrigerator in accordance with the difference between the instan-
(Continued)

taneous values of the parameter relative to said dynamic converge toward said dynamic mean value.

10 Claims, 3 Drawing Sheets

(51) Int. Cl.
*F25B 1/10* (2006.01)
*F25B 9/00* (2006.01)
*F25J 1/00* (2006.01)

(52) U.S. Cl.
CPC ..... *F25J 1/02* (2013.01); *F25J 1/0244* (2013.01); *F25J 1/0265* (2013.01); *F25J 1/0272* (2013.01); *F25J 1/027* (2013.01); *F25J 2270/912* (2013.01)

(58) Field of Classification Search
USPC ..... 62/51.2, 608
See application file for complete search history.

(56) References Cited

OTHER PUBLICATIONS

French Search Report and Written Opinion for FR 1 457 100 dated Mar. 20, 2015.
International Search Report and Written Opinion for PCT/FR2015/051492 dated Aug. 28, 2015.
International Search Report and Written Opinion for PCT/FR2015/051492 dated Aug. 28, 2015 (English machine translation).

* cited by examiner

METHOD FOR ADJUSTING A CRYOGENIC REFRIGERATION APPARATUS AND CORRESPONDING APPARATUS

CROSS REFERENCE TO RELATED APPLICATIONS

This application is a 371 of International PCT Application PCT/FR2015/051492 filed Jun. 5, 2015, which claims priority to French Patent Application No. 1457100 filed Jul. 23, 2014, the entire contents of which are incorporated herein by reference.

BACKGROUND

The present invention relates to a method for adjusting a cryogenic refrigeration apparatus and to a corresponding apparatus.

The invention relates more particularly to a method for adjusting a cryogenic refrigeration apparatus comprising several refrigerators/liquefiers arranged in parallel to cool one and the same application, each refrigerator/liquefier comprising a working circuit for a working gas equipped with at least one valve for controlling the flow of working gas, the refrigerator/liquefiers in parallel using a working gas of the same kind such as pure gaseous helium, each refrigerators/liquefier comprising a working gas compression station, a cold box intended to cool a flow of working gas leaving the compression station to a cryogenic temperature at least close to its liquefaction temperature, said flows of working gas cooled by each of the respective cold boxes of the refrigerators/liquefiers being mixed and then placed in a heat exchange relationship with the application in order to give up frigories thereto, the cold working gas having exchanged heat with the application then being divided into several return flows distributed respectively through the respective compression stations.

The invention relates to what is referred to as "large-scale" refrigeration apparatuses employing several refrigerators/liquefiers in parallel in order to cool one and the same user application A "refrigerator/liquefier" denotes a device which subjects a working gas (for example helium) to a thermodynamic cycle of work (compression/expansion) that brings the working fluid to a cryogenic temperature (for example a few degrees K in the case of helium) and where appropriate liquefies this working gas.

One nonlimiting example of such an apparatus is described in application no. FR2980564A1.

The refrigeration cycles (which generate cold) are said to be "closed" at the level of each refrigerator. What that means to say is that the flow of working gas that enters the cold box of a refrigerator/liquefier reemerges for the most part from this same cold box. By contrast, the flow of working gas is said to be "open" at the level of the application that is to be cooled, which means to say that the gas from the various refrigerators/liquefiers is mixed therein. The flow of working gas supplied by the refrigerators/liquefiers is therefore pooled for cooling the application then returned separately to each refrigerator by a distribution system.

Adjustment of the refrigerators of such an apparatus generally involves manually positioning the control valves of the working circuit (from and to the application that is to be cooled).

Suitable adjustment becomes more difficult when the apparatus comprises a great many interfaces and when the thermal loads that need to be cooled vary over time. This is because static adjustment of the valves may be unsuitable if the flow rate and/or pressure of the system vary.

The fluctuating thermal loads of the application indeed generate fluctuations in the flow rate through the compressors.

If this is not corrected, certain refrigerators/liquefiers will recuperate more working gas and cold than others. Thus, certain refrigerators/liquefiers may diverge from their nominal operating point. Certain components of these refrigerators/liquefiers may therefore be used at their limit (compressors, turbines, etc.) whereas the other refrigerators/liquefiers will be underutilized. The overall cold power of the apparatus and the efficiency thereof will therefore be reduced.

Providing systems for control and adjusting the independent flows for each refrigerator/liquefier may lead to a system which overall is unstable in which the loads and flow rates will be distributed inconsistently between the refrigerators/liquefiers. In addition, the specific features of helium (a density that varies greatly as a function of temperature) lead to a phenomenon in which the imbalances between the refrigerators are amplified.

The distribution of helium flow rates between the refrigerators is performed generally via a common helium feed pressure and the resistance (pressure drop) of the circuit returning to the source of pressure (compressors).

When one refrigerator/liquefier receives in relative terms more cold gas coming from the application, the mean temperature of the return circuit drops and the pressure drop of the circuit is therefore reduced. Specifically, the density of the gas may change more rapidly than the speed of the gas through the circuit. This drop in pressure drop in a circuit leads to a relative increase in the flow rate of cold gas accepted into the circuit concerned and therefore leads to divergence within the apparatus.

It is an object of the present invention to alleviate all or some of the disadvantages mentioned hereinabove of the prior art.

SUMMARY

To this end, the method according to the invention, in other respects in accordance with the generic definition given thereof in the above preamble, is essentially characterized in that it comprises a step of simultaneous measurement, for each of the refrigerators/liquefiers, of the instantaneous value of at least one and the same operating parameter from: a flow rate of what is referred to as a "return" flow of working gas returning to the compression station, a flow rate of what is referred to as an "outbound" flow of working gas circulating through the cold box having left the compression station, a differential in temperature of the working gas between, on the one hand, the outbound flow of working gas and, on the other hand, the return flow of working gas, both flows being situated in the cold box in one and the same temperature range, the method comprising a step of real-time calculation of the dynamic mean value of the at least one operating parameter for all the refrigerators/liquefiers, the apparatus performing real-time control of the at least one working gas flow control valve of at least one refrigerator/liquefier as a function of the difference between the instantaneous values of the parameter with respect to said dynamic mean value, so as to cause said instantaneous values of said operating parameter of the various refrigerators/liquefiers to converge toward this dynamic mean value.

This particular feature allows the apparatus to be adjusted dynamically in order to react automatically to the variations in refrigerator parameters (temperature, pressure, flow rate, level, etc.).

This adjustment makes it possible to get as close as possible to the predetermined optimum operation (calculated beforehand) in which the various refrigerators/liquefiers operate identically (same flow rates/pressure/temperature of the working gas in the circuit).

In order to meet this requirement, the method compares one of the dynamic parameters indicative of the operation of a refrigerator and compares it against the mean of this same parameter across all the other refrigerators. The control action of the method uses this difference in value of the parameter to modify the set point of the regulators existing on each refrigerator having an impact on the parameter. That then also modifies the mean of the parameters and therefore the set point is also updated. This is a control system which may be qualified as being "in cascade" with a set point that is "dynamic" that causes each parameter to converge toward the mean of this parameter across the various refrigerators.

Moreover, embodiments of the invention may comprise one or several of the following features:

the refrigerators/liquefiers are identical, the apparatus performing real-time control of the at least one working gas flow control valve of at least one refrigerator/liquefier as a function of the difference between the instantaneous values of the parameter with respect to said dynamic mean value, so as to cause said instantaneous values of said operating parameter of the various refrigerators/liquefiers to converge toward a determined identical value, the refrigerators/liquefiers are identical, the apparatus performing real-time control of the at least one working gas flow control valve of at least one refrigerator/liquefier as a function of the difference between the instantaneous values of the parameter with respect to said dynamic mean value in order at once to cause said instantaneous values of the flow rates of the return flow of working gas returning toward the compression stations to converge toward a determined identical flow value, to cause the differential in temperature of the working gas between the outbound flow of working gas in the cold box and the return flow of working gas returning toward the compression station to converge toward a determined identical temperature differential value and to cause the flow rate of the flow of cooled working gas at the outlet of each cold box to converge toward a determined identical flow rate value, the compression station of each refrigerator/liquefier comprises two compressors arranged in series on the working circuit and respectively designated "low-pressure compressor" and "medium-pressure compressor", a bypass circuit for selectively bypassing the low-pressure compressor comprising at least one variable-opening controlled bypass valve, the method comprising simultaneous measurement, for each of the refrigerators/liquefiers, of the operating parameter consisting of the instantaneous value of the flow rate of the return flow of working gas returning toward the compression station, the method comprising a step of real-time calculation of the dynamic mean value of the operating parameter for all the refrigerators/liquefiers, the apparatus performing real-time control of the opening/closing of each bypass valve as a function of the difference between the instantaneous values of the operating parameter of the refrigerator/liquefier concerned in order to cause said instantaneous values of said operating parameter of the various refrigerators/liquefiers to converge toward this dynamic mean value, the method comprises simultaneous measurement, for each of the refrigerators/liquefiers, of the differential in temperature of the working gas between, on the one hand, the return flow and, on the other hand, the outbound flow at the same temperature level in the cold box, control of each bypass valve being corrected as a function of the discrepancy between said differential in temperature for the refrigerator/liquefier concerned and the mean of said temperature differential calculated for all of the refrigerators/liquefiers, the opening/closing of each bypass valve being reduced when the temperature differential for the refrigerator/liquefier concerned increases in terms of absolute value with respect to the mean of said temperature differential, at the outlet of the compression station, each refrigerator/liquefier comprises a variable-opening controlled outlet valve, the method comprising simultaneous measurement, for each of the refrigerators/liquefiers, of the operating parameter consisting of the instantaneous value of the flow rate of the outlet flow of working gas, the method comprising a step of real-time calculation of the dynamic mean value of the operating parameter for all the refrigerators/liquefiers, the apparatus performing real-time control of the opening/closing of each outlet valve as a function of the difference between the instantaneous values of the operating parameter of the refrigerator/liquefier concerned so as to cause said instantaneous values of said operating parameter of the various refrigerators/liquefiers to converge toward this dynamic mean value, each outlet valve is controlled according to a pressure set point measured at the outlet of said valve, the apparatus performing real-time control of the opening/closing of each outlet valve so as to reduce the pressure set point when the instantaneous value of the flow rate of the flow of gas at the outlet of the compression station of the refrigerator/liquefier concerned is greater than said dynamic mean value, and vice versa, the working circuit comprises, in the cold box of each refrigerator/liquefier, a main pipe comprising a working gas cooling exchanger immersed in a cryogenic tank of liquefied working gas and a secondary pipe forming a bypass of the main pipe upstream of the cryogenic tank and opening into the latter so as to be able to deliver thereto liquefied working gas produced by the cold box, the main pipe comprising a variable-opening controlled downstream valve situated downstream of the cooling exchanger, the method comprising simultaneous measurement, for each of the refrigerators/liquefiers, of the operating parameter consisting of the instantaneous value of the flow rate of the outlet flow of working gas in said main pipe downstream of the cooling exchanger, the method comprising a step of real-time calculation of the dynamic mean value of this operating parameter for all of the refrigerators/liquefiers, the apparatus performing real-time control over the opening/closing of each downstream valve as a function of the difference between the instantaneous values of this operating parameter of the refrigerator/liquefier concerned in order to make said instantaneous values of said operating parameter of the various refrigerators/liquefiers converge toward this dynamic mean value, the secondary pipe is provided with a variable-opening distribution valve the opening of which is increased in the event of an increased production of liquefied working gas in the cold box, in that control of each downstream valve is corrected as a function of the state of opening of the distribution valve so as to reduce the opening of the downstream valve when the opening of the distribution valve increases, and vice versa, the cold box of each refrigerator/liquefier comprises a plurality of heat exchangers for cooling the working fluid and a bypass pipe for bypassing at least some of said exchangers supplying working gas at the outlet of the cold box, said bypass pipe being connected to the rest of the working circuit in a heat exchange relationship with the exchangers via variable-opening respective controlled bypass valves, the method comprising simultaneous measurement, for each of the refrigerators/liquefiers, of the operating parameter consisting of the instantaneous value of the flow rate of the flow of gas in said bypass pipe, the method comprising a step of real-time calculation of the dynamic mean value of this operating parameter for all of the refrigerators/liquefiers, the apparatus performing real-time control of the opening/closing of at least one of the bypass valves as a function of the difference between the instantaneous values and the dynamic mean value of this operating parameter of the refrigerator/liquefier concerned, so as to cause said instantaneous values of said operating parameter of the various refrigerators/liquefiers to converge toward this dynamic mean value, the working circuit comprises, inside the cold box of each refrigerator/liquefier, a plurality of exchangers for warming up the cold working fluid that has exchanged heat with the application, the working circuit comprising a pipe for returning the return flow of working gas returning to the compression station, the return pipe comprising a portion that is subdivided into two parallel branches referred to respectively as the "hot" leg and as the "cold" leg, the hot leg bypassing at least some of the warming up exchangers, the cold leg being thermally coupled to the warming up exchangers, the working fluid having exchanged heat with the application returning to the compression station being distributed through the hot leg when its temperature is above a determined threshold or the cold leg when its temperature is below the determined threshold, each hot leg comprising a variable-opening controlled regulating valve, the method comprising a simultaneous measurement, for each of the refrigerators/liquefiers, of the operating parameter that consists of the instantaneous value of the flow rate of the flow of gas in said hot leg, the method comprising a step of real-time calculation of the dynamic mean value of this operating parameter for all the refrigerators/liquefiers, the apparatus performing real-time control of the opening/closing of the valve of the hot leg as a function of the difference between the instantaneous values and the dynamic mean value of this operating parameter of the refrigerator/liquefier concerned, so as to cause said instantaneous values of said operating parameter of the various refrigerators/liquefiers to converge toward this dynamic mean value, each cold leg comprises a variable-opening controlled regulating valve, the method comprising simultaneous measurement, for each of the refrigerators/liquefiers, of the operating parameter consisting of the instantaneous value of the flow rate of the flow of gas in said cold leg, the method comprising a step of real-time calculation of the dynamic mean value of this operating parameter for all the refrigerators/liquefiers, the apparatus performing real-time control of the opening/closing of the valve of the cold leg as a function of the difference between the instantaneous values and the dynamic mean value of this operating parameter for the refrigerator/liquefier concerned, so as to cause said instantaneous values of said operating parameter of the various refrigerators/liquefiers to converge toward this dynamic mean value.

The invention may also relate to any alternative device or method comprising any combination of the features above or below.

The invention may also relate to a cryogenic refrigeration apparatus comprising several refrigerators/liquefiers arranged in parallel to cool one and the same application, each refrigerators/liquefier comprising a working circuit for a working gas equipped with at least one valve for controlling the flow of working gas, the refrigerators/liquefiers in parallel using a working gas of the same kind such as pure gaseous helium, each refrigerator/liquefier comprising a working gas compression station, a cold box intended to cool a flow of working gas leaving the compression station to a cryogenic temperature at least close to its liquefaction temperature, said flows of working gas cooled by each of the respective cold boxes of the refrigerators/liquefiers being mixed and then placed in a heat exchange relationship with the application in order to give up frigories thereto, the cold working gas having exchanged heat with the application then being divided into several return flows distributed respectively through the respective compression stations, the apparatus comprising electronic control logic connected to simultaneous measurement means, for measuring, for each of the refrigerators/liquefiers, the instantaneous value of at least one and the same operating parameter from: a flow rate of what is referred to as a "return" flow of working gas returning to the compression station, a flow rate of what is referred to as an "outbound" flow of working gas circulating through the cold box after having left the cold box, a differential in temperature of the working gas between, on the one hand, an outbound flow of working gas within the cold box and, on the other hand, the return flow of working gas in the cold box, the electronic logic being configured for real-time calculation of the dynamic mean value of the at least one operating parameter for all the refrigerators/liquefiers, and to perform real-time control of the at least one control valve controlling the flow of working gas from at least one refrigerator/liquefier according to the difference between the instantaneous values of the parameter compared with said dynamic mean value in order to cause said instantaneous values of said operating parameter of the various refrigerators/liquefiers to converge toward this dynamic mean value.

The invention also relates to any alternative device or method comprising any combination of the features above or below.

BRIEF DESCRIPTION OF THE DRAWINGS

Further specifics and advantages will become apparent from reading the following description, given with reference to the figures in which.

DESCRIPTION OF PREFERRED EMBODIMENTS

Figure 1:
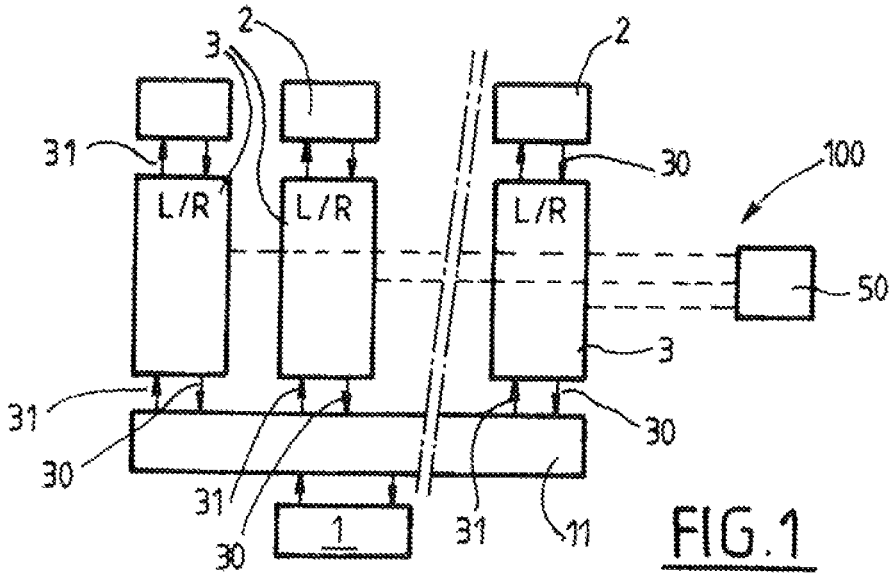
FIG. 1 depicts a schematic and partial view illustrating one example of the structure and operation of an apparatus able to implement the invention.

FIG. 1 schematically illustrates a cryogenic refrigeration apparatus comprising three refrigerators/liquefiers (L/R) arranged in parallel to cool one and the same application 1. Conventionally, each refrigerator/liquefier L/R comprises a working circuit for a working gas which is equipped with at least one working gas flow control valve.

Each refrigerator/liquefier comprises its own station 2 for compressing the working gas and its own cold box 3 intended to cool the flow 30 of working gas leaving the compression station 2 to a cryogenic temperature at least close to its liquefaction temperature.

The flows 30 of working gas cooled by each of the respective cold boxes 3 of the refrigerators/liquefiers L, R are mixed and then placed in a heat exchange relationship with the application 1 in order to give up frigories thereto. The cold working gas having exchanged heat with the application 1 is then split into several return flows 31 distributed respectively across the compression stations 2.

The parallel refrigerators/liquefiers L/R use a working gas of the same nature such as pure gaseous helium.

The apparatus 100 preferably comprises electronic control logic 50 comprising for example a microprocessor (a computer and/or controller). The electronic logic 50 is connected to measurement members for simultaneous measurement, for each of the refrigerators/liquefiers L/R, of the instantaneous value of at least one and the same operating parameter regarding the working gas in the working cycle of each of the refrigerators/liquefiers L/R. For the sake of simplicity, FIG. 1 does not depict these measurement members (examples thereof will be illustrated in FIGS. 2 to 6).

The at least one operating parameter measured for each refrigerator/liquefier L/R preferably comprises at least one out of: a flow rate of the return flow of working gas returning to the compression station (after exchanging heat with the application or a return flow of working gas returning directly to the compression station without passing via the application 1 or certain parts of the cold box 3), a flow rate of the flow of cooled working gas at the outlet of the cold box (after having left the compression station), a differential in temperature of the working gas between, on the one hand, the flow of working gas in the cold box (heading toward the application) and, on the other hand, the return flow of working gas returning to the compression station (from the application).

The electronic logic 50 is configured (for example programmed) to perform real-time calculation of the dynamic mean value of the at least one operating parameter for all the refrigerators/liquefiers L/R and for performing real-time control of the at least one working-gas flow control valve of at least one refrigerator/liquefier L/R as a function of the difference between the instantaneous values of the parameter with respect to said dynamic mean value. More specifically, the electronic logic is configured to cause said instantaneous values of said operating parameter of the various refrigerators/liquefiers R/L to converge toward this dynamic mean value.

What that means to say is that each refrigerator/liquefier L/R is controlled in its working cycle as a function of an operating mean of the whole set of refrigerators/liquefiers L/R, so as to cause all the refrigerators/liquefiers L/R to converge toward this mean.

This adjustment may be implemented via controllers of the "proportional integral" (PI) type for controlling the working-gas circuits.

For preference, the apparatus performs real-time control of the at least one working-gas flow control valve of at least one refrigerator/liquefier (L/R) as a function of the difference between the instantaneous values of the parameter with respect to said dynamic mean value, so as to cause said instantaneous values of said operating parameter of the various refrigerators/liquefiers R/L to converge toward this dynamic mean value.

Various examples of the control of the apparatus will be described with reference to FIGS. 2 to 6 respectively. All or some of these various examples may be implemented cumulatively or alternatively in order to adjust the operation of such an apparatus 100.

Figure 2:
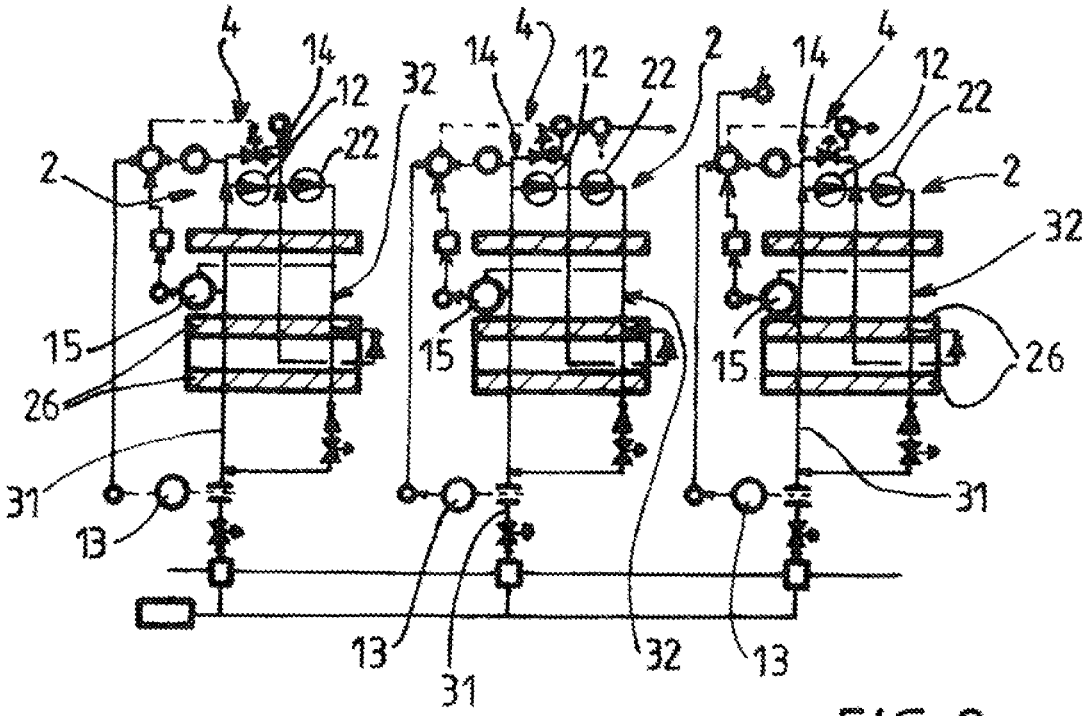
FIG. 2 depicts a schematic and partial view of a detail of the apparatus of FIG. 1, illustrating an example of the structure and operation of part of the compression stations and of the cold boxes of the refrigerators/liquefiers of the apparatus.

As partially illustrated in FIG. 2, the compression station 2 of each refrigerator/liquefier may comprise two compressors 12, 22 arranged in series on the working circuit and referred to respectively as the "low-pressure compressor" 12 and the "medium-pressure compressor" 12. The low-pressure compressor 12 receives the relatively hot working gas returning at low pressure (return flow 31) having passed or not passed through the cold box 3.

Each compression station 2 comprises a bypass circuit 14 for selectively bypassing the low-pressure compressor 12 and which is equipped with a variable-opening controlled bypass valve 4.

The apparatus comprises, for each of the refrigerators/liquefiers L/R, a sensor 13 for measuring the operating parameter consisting of the instantaneous value of the flow rate Q of the return flow 31 of working gas returning to the compression station 2. This measurement sensor 3 is, for example, situated within the cold box 3, upstream of one or more exchangers 26 which both cool toward the working gas toward the application and heat the working gas returning toward the compression station 2.

The electronic logic 50 may perform real-time calculation of the dynamic mean value of this operating parameter for all the refrigerators/liquefiers L/R. The electronic logic 50 performs real-time control of the opening/closing of each bypass valve 14 as a function of the difference between the instantaneous values of the operating parameter of the refrigerator/liquefier concerned so as to cause said instantaneous values of said operating parameter of the various refrigerators/liquefiers R/L to converge toward this dynamic mean value.

For example, the opening/closing of each bypass valve 14 is controlled according to a pressure set point CP according to a formula of the type CP=A−B·ΔQ, where A is a predetermined pressure value, B is a predetermined coefficient (dimensions=pressure/flow rate) and ΔQ is the differential (dimensions=flow rate) between, on the one hand, the dynamic mean value of the flow rate of the three coolers and, on the other hand, the instantaneous flow rate of the refrigerator/liquefier concerned.

In addition, each refrigerator/liquefier L/R may comprise a sensor 15 for measuring the temperature differential DT=T31−T32 of the working gas between the return flow 31 (returning to the compression station) and the "outbound" flow 32 (toward the application 1) which are situated in the cold box (3) in a part of the circuit that has one and the same determined temperature range.

The expression "one and the same temperature range in the cold box" means points on the working circuit at which the outbound flow 32 (toward the application that is to be cooled 1) and return flow 31 (toward the compression station 2) are situated at the same level with respect to the cooling exchangers of the cold box 3 (for example, the two measurement points are situated in legs of the circuit which are situated between two same cooling exchangers). What that means to say is that the two points on the circuit have relatively similar temperatures, for example differing by just a few degrees Kelvin (typically between 0.1 and 4° K. of difference).

The outbound flow 32 is, for example, the flow of working gas leaving a cooling exchanger of the cold box (for example at the outlet of the first heat exchanger which cools the working gas after it has passed through the compression station 2). The return flow 31 in the same temperature range is the part of the working circuit in which the working gas returns toward the compression station 2 before entering this same heat exchanger. According to one advantageous feature, the control of each bypass valve 14 may be corrected as a function of the discrepancy between said temperature differential DT=T31−T32 for the refrigerator/liquefier L/R concerned with respect to the mean of said temperature differential DT=T31−T32 calculated for all of the refrigerators/liquefiers L/R. This temperature differential DT=T31−T32 is indicative of the imbalance in the flow rates of working gas between the return flow 31 (toward the compression station) and the outbound flow 32 (toward the application 1).

For example, the opening of each bypass valve 14 may be increased when the temperature differential DT=T31−T32 for the refrigerator/liquefier L/R concerned increases (in terms of absolute value) with respect to the mean of said temperature differential. This control will have the effect of reducing the imbalance in the flow rates of the working gas between the return flow 31 (toward the compression station) and the outbound flow 32 (toward the application 1).

Figure 3:
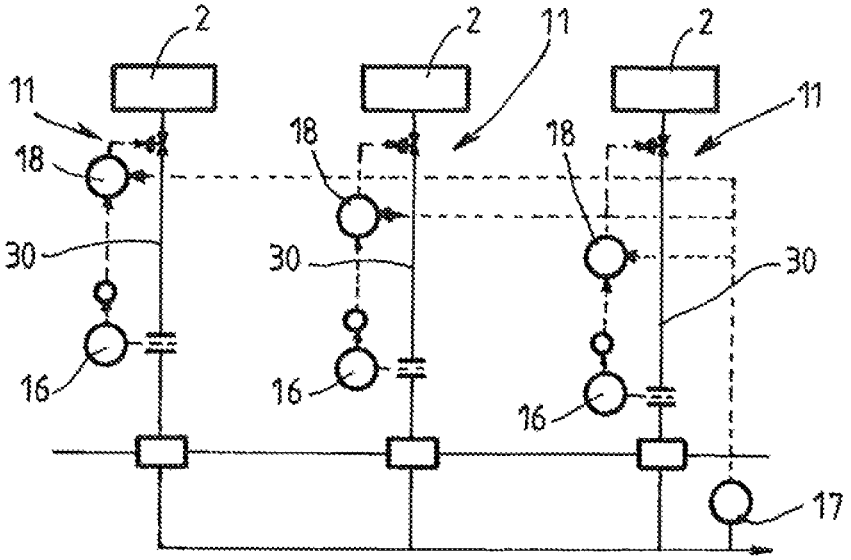
FIG. 3 depicts a schematic and partial view of a detail of the apparatus of FIG. 1, illustrating one example of the structure and operation of part of the working circuit at the outlet of the compression stations.

As illustrated schematically in FIG. 3, at the outlet of the compression station 2, each refrigerator/liquefier L/R may, on the outlet pipe 30, comprise a variable-opening controlled outlet valve 11.

In addition, each refrigerator/liquefier L/R may comprise a measurement sensor 16 for measuring the operating parameter consisting of the instantaneous value of the flow rate of the flow 30 of gas at the outlet of the compression station 2.

As previously, the electronic logic 50 may be configured to perform real-time calculation of the dynamic mean of this operating parameter for all the refrigerators/liquefiers L/R. The electronic logic 50 may perform real-time control of the opening/closing of each outlet valve 11 according to the difference between the instantaneous values of the operating parameter of the refrigerator/liquefier concerned so as to cause said instantaneous values of said operating parameter of the various refrigerators/liquefiers R/L to converge toward this dynamic mean value.

For example, the opening/closing of each outlet valve 11 is controlled according to a pressure set point CP according to a formula of the type CP=C+D·ΔQ, where B is a predetermined pressure value, C is a predetermined coefficient (dimensions=pressure/flow rate) and ΔQ is the differential (dimensions=flow rate) between, on the one hand, the dynamic mean value of this flow rate for the three coolers and, on the other hand, this instantaneous flow rate for the refrigerator/liquefier concerned.

Figure 4:
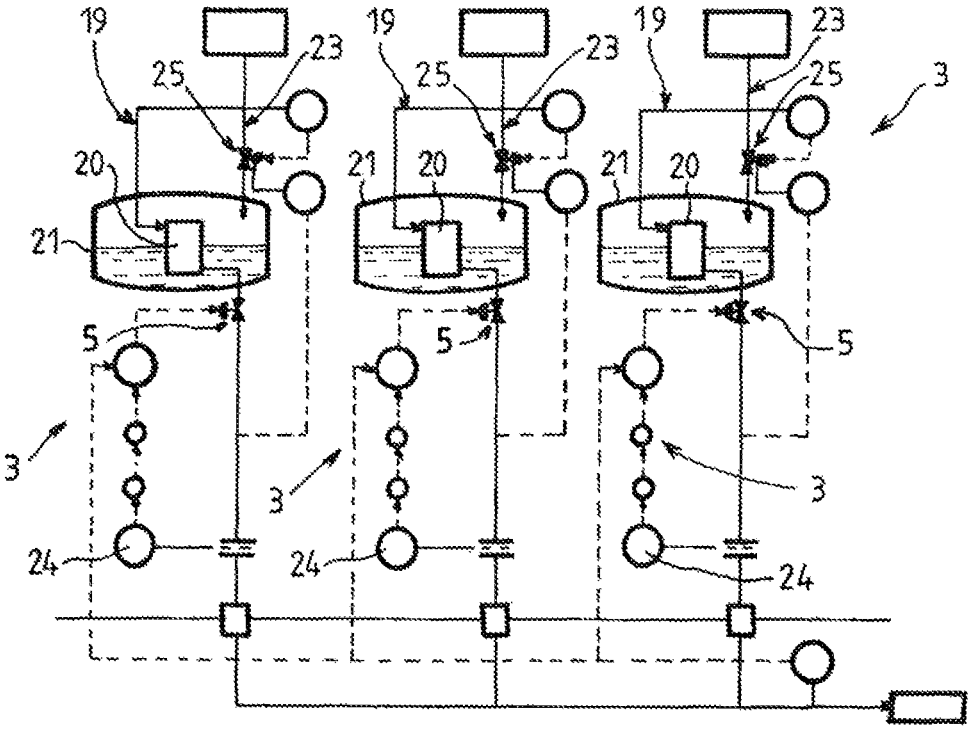
FIG. 4 depicts a schematic and partial view of a detail of the apparatus of FIG. 1, illustrating one example of the structure and operation of part of the working circuit at the level of the liquefied working gas storage reservoirs.

As illustrated in FIG. 4, the working circuit of each refrigerator/liquefier may, in the cold box 3, comprise a main pipe 19 comprising an exchanger 20 for cooling the working gas which is immersed in a cryogenic tank 21 of liquefied working gas and a secondary pipe 23 forming a bypass of the main pipe upstream of the cryogenic tank 21. The secondary pipe 23 opens into this tank 21 into which it delivers the liquefied working gas produced by the cold box 3.

Each main pipe 19 comprises a variable-opening controlled downstream valve 5 situated downstream of the cooling exchanger 20. Each apparatus comprises a sensor 24 of the operating parameter consisting of the instantaneous value of the flow rate of the flow of working gas in said main pipe 23 downstream of the flow cooling exchanger 20.

The electronic logic 50 may be configured to perform real-time calculation of the dynamic mean value of this operating parameter for all the refrigerators/liquefiers L/R and to perform real-time control of the opening/closing of each downstream valve 5 as a function of the difference between the instantaneous values of this operating parameter of the refrigerator/liquefier concerned so as to cause said instantaneous values of said operating parameter of the various refrigerators/liquefiers R/L to converge toward this dynamic mean value.

For example, the secondary pipe 23 is equipped with a variable-opening distribution valve 25, the opening of which is increased in the event of increased production of liquefied working gas in the cold box 3. In addition, control of each downstream valve 5 may be corrected according to the degree of opening of the distribution valve 25 so as to reduce the opening of the downstream valve 5 when the opening of the distribution valve 25 increases, and vice versa.

Figure 5:
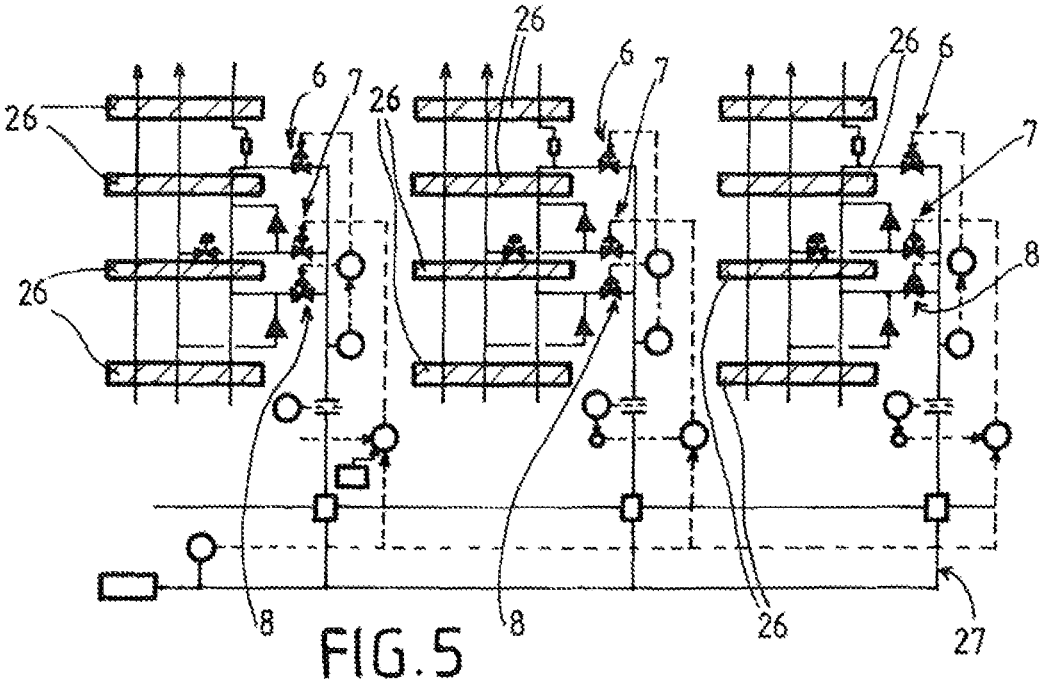
FIG. 5 depicts a schematic and partial view of a detail of the apparatus of FIG. 1, illustrating one example of the structure and operation of part of the working circuit at a bypass pipe bypassing cooling exchangers of the cold box.

As illustrated in FIG. 5, the cold box 3 of each refrigerator/liquefier L/R may comprise a plurality of heat exchangers 26 for cooling the working fluid and a bypass pipe 27 bypassing at least some of said exchangers 26. This bypass pipe 27 bypassing the exchangers 26 provides downstream working gas leaving the cold box 3.

As depicted, the bypass pipe 27 is connected to several portions of the working circuit in a heat exchange relationship with the exchangers 26 via respective controlled bypass valves 6, 7, 8 (valves with variable opening).

Each refrigerator/liquefier may comprise a measurement sensor 28 for measuring the operating parameter consisting of the instantaneous value of the flow rate of the flow of gas in said bypass pipe 27. The electronic logic 50 may comprise a step of real-time calculation of the dynamic mean value of this operating parameter for all the refrigerators/liquefiers L/R and for the real-time control of the opening/closing of at least one of the bypass valves 6, 7, 8 as a function of the difference between the instantaneous values and the dynamic mean value of this operating parameter of the refrigerator/liquefier concerned, so as to cause said instantaneous values of said operating parameter of the various refrigerators/liquefiers R/L to converge toward this dynamic mean value.

Figure 6:
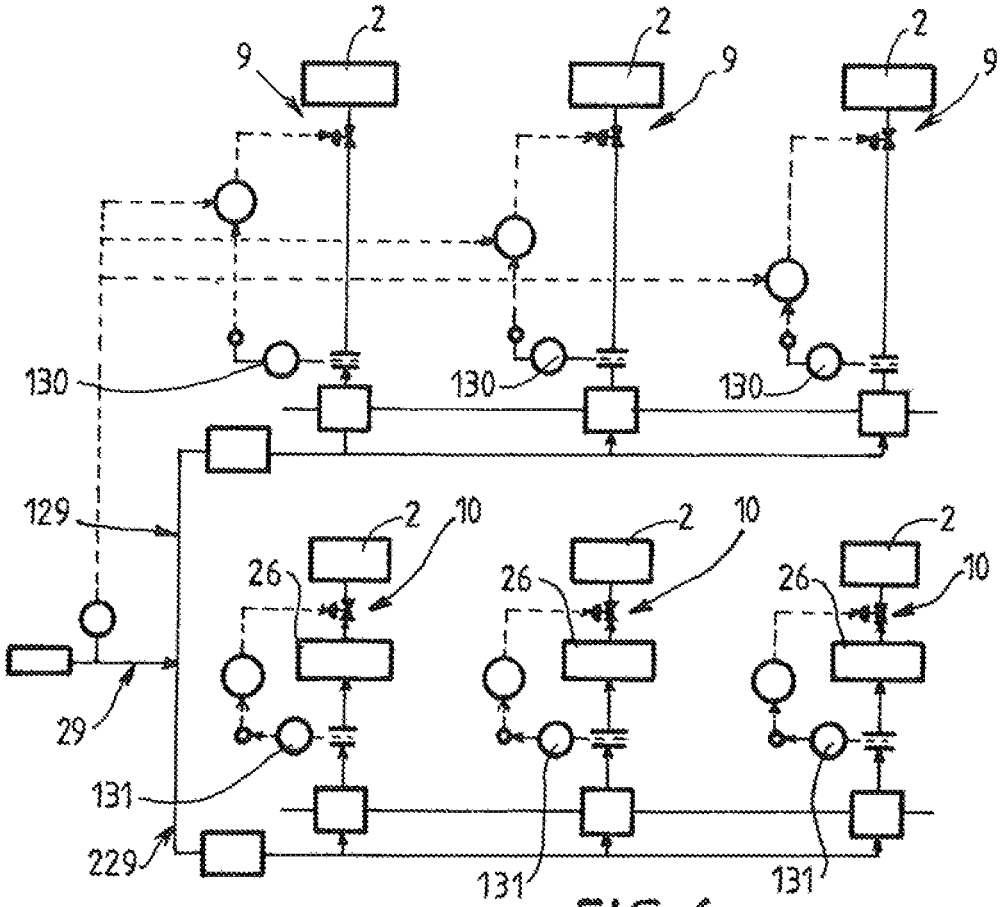
FIG. 6 depicts a partial and schematic view of a detail of the apparatus of FIG. 1, illustrating one example of the structure and operation of part of the working circuit at a return pipe returning working gas to the compression station.

For example, the opening/closing of the bypass valve 7 is controlled according to a pressure set point CP according to a formula of the type CP=G+H·ΔQ, where G is a predetermined pressure value, G is a predetermined coefficient (dimensions=pressure/flow rate) and ΔQ is the differential (dimensions=flow rate) between, on the one hand, the dynamic mean value of this flow rate for the three coolers and, on the other hand, this instantaneous flow rate for the refrigerator/liquefier concerned. The other bypass valves 6, 8 allow adjustment of the temperature of the circuit for the refrigerator/liquefier concerned. As illustrated in FIG. 6, the working circuit may, in the cold box 3 of each refrigerator/liquefier L/R, comprise a plurality of exchangers 26 for warming up the cold working fluid that has exchanged heat with the application 1. The working circuit additionally comprises a return pipe 29 for the flow 30 of working gas returning to the compression station 2, the return pipe 29 comprising a portion that is subdivided into two parallel legs 129, 229 respectively referred to as the "hot" and "cold" leg. The hot leg 129 does not exchange heat with at least part of the heating heat exchangers 26. The cold leg 229 itself exchanges heat with several warming up exchangers. The working fluid that has exchanged heat with the application returns to the compression station 2 and is distributed into the hot leg 129 when its temperature is above a determined threshold or into the cold leg 229 when its temperature is below the determined threshold. Each hot leg 129 comprises a variable-opening controlled regulating valve 9.

Each cold box 3 comprises a measurement sensor 130 for measuring the operating parameter consisting of the instantaneous value of the flow rate of the flow of gas in said hot leg 129.

The electronic logic 50 may be configured to perform real-time calculation of the dynamic mean value of this operating parameter for all the refrigerators/liquefiers and to perform real-time control of the opening/closing of the valve 9 of the hot leg 129 as a function of the difference between the instantaneous values and the dynamic mean value of this operating parameter of the refrigerator/liquefier concerned, so as to cause said instantaneous values of said operating parameter of the various refrigerators/liquefiers to converge toward this dynamic mean value.

For example, the opening/closing of each valve 9 of the hot leg is controlled according to a pressure set point CP according to a formula of the type CP=I+J·ΔQ, where I is a predetermined pressure value, J is a predetermined coefficient (dimensions=pressure/flow rate) and ΔQ is the differential (dimensions=flow rate) between, on the one hand, the dynamic mean value of this flow rate for the three coolers and, on the other hand, this instantaneous flow rate for the refrigerator/liquefier concerned.

Similarly, each cold leg 229 comprises a variable-opening controlled regulating valve 10 and a measurement sensor 131 for measuring the operating parameter consisting of the instantaneous value of the flow rate of the flow of gas in said leg 229. The electronic logic 50 may be configured to perform real-time calculation of the dynamic mean value of this operating parameter for all the refrigerators/liquefiers and to perform real-time control of the opening/closing of the valve 10 of the cold leg 229 as a function of the difference between the instantaneous values and the dynamic mean value of this operating parameter of the refrigerator/liquefier concerned, so as to cause said instantaneous values of said operating parameter of the various refrigerators/liquefiers R/L to converge toward this dynamic mean value.

As before, the opening/closing of each valve 10 of the cold leg may be controlled according to a pressure set point CP according to a formula of the type CP=K+L·ΔQ, where K is a predetermined pressure value, L is a predetermined coefficient (dimensions=pressure/flow rate) and ΔQ is the differential (dimensions=flow rate) between, on the one hand, the dynamic mean value of this flow rate for the three coolers and, on the other hand, this instantaneous flow rate for the refrigerator/liquefier concerned.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A method for adjusting a cryogenic refrigeration apparatus comprising several refrigerators/liquefiers arranged in parallel to cool a single device, each of the several refrigerator/liquefier comprising a working circuit comprising a working gas, the working circuit equipped with at least one valve for controlling the flow of the working gas, the several refrigerators/liquefiers in parallel using identical working gas, each of the several refrigerator/liquefier comprising a respective working gas compression station, a cold box configured to cool a flow of the working gas leaving the compression station to a cryogenic temperature at within 4 K the liquefaction temperature, said flows of the working gas cooled by each of the respective cold boxes of the of the several refrigerators/liquefiers being mixed and then placed in a heat exchange relationship with the single device in order to give up frigories thereto, the cold working gas having exchanged with the single device then being divided into several return flows distributed respectively through the respective compression stations, the method comprising a step of simultaneous measurement, for each of the of the several refrigerators/liquefiers, of the instantaneous value of at least one and the same operating parameter selected from the group consisting of: a flow rate of the working gas returning to the compression station a flow rate of the working gas circulating through the cold box having left the compression station, and a differential in temperature of the working gas between the outbound flow of the working gas and the return flow of the working gas, both flows being situated in the cold box in the same temperature range, and in that the method comprises a step of real-time calculation of the dynamic mean value of the at least one operating parameter for all the several refrigerators/liquefiers the apparatus performing real-time control of the at least one working gas flow control valve of the at least one refrigerator/liquefier as a function of the difference between the instantaneous values of the parameter with respect to said dynamic mean value, so as to cause said instantaneous values of said operating parameter of the several refrigerators/liquefiers to converge toward this dynamic mean value, wherein the working circuit comprises, in the cold box of each of the several refrigerator/liquefier, a main pipe comprising a working gas cooling exchanger immersed in a cryogenic tank of liquefied working gas and a secondary pipe forming a bypass of the main pipe upstream of the cryogenic tank and opening into the latter so as to be able to deliver thereto liquefied working gas produced by the cold box, the main pipe comprising a variable-opening controlled downstream valve situated downstream of the cooling exchanger, the method comprising simultaneous measurement for each of the several refrigerators/liquefiers, of the operating parameter consisting of the instantaneous value of the flow rate of the outlet flow of the working gas in said main pipe downstream of the cooling exchanger, the method comprising a step of real-time calculation of the dynamic mean value of this operating parameter for all of the several refrigerators/liquefiers, the apparatus performing real-time control over the opening/closing of each downstream valve as a function of the difference between the instantaneous values of this operating parameter of the several refrigerator/liquefier in order to make said instantaneous values of said operating parameter of the several refrigerators/liquefiers converge toward this dynamic mean value.

2. The method of claim 1, wherein the refrigerators/liquefiers are identical, the apparatus performing real-time control of the at least one working gas flow control valve of at least one refrigerator/liquefier as a function of the difference between the instantaneous values of the parameter with respect to said dynamic mean value in order at once to cause said instantaneous values of the flow rates of the return flow of working gas returning toward the compression stations to converge toward a determined identical flow value, to cause the differential in temperature of the working gas between the outbound flow of working gas in the cold box and the return flow of working gas returning toward the compression station to converge toward a determined identical temperature differential value and to cause the flow rate of the flow of cooled working gas at the outlet of each cold box to converge toward a determined identical flow rate value.

3. The method of claim 1, wherein the compression station of each refrigerator/liquefier comprises two compressors arranged in series on the working circuit and respectively designated "low-pressure compressor" and "medium-pressure compressor", a bypass circuit for selectively bypassing the low-pressure compressor comprising at least one variable-opening controlled bypass valve, the method comprising simultaneous measurement, for each of the refrigerators/liquefiers, of the operating parameter consisting of the instantaneous value of the flow rate of the return flow of working gas returning toward the compression station, the method comprising a step of real-time calculation of the dynamic mean value of the operating parameter for all the refrigerators/liquefiers, the apparatus performing real-time control of the opening/closing of each bypass valve as a function of the difference between the instantaneous values of the operating parameter of the refrigerator/liquefier concerned in order to cause said instantaneous values of said operating parameter of the various refrigerators/liquefiers to converge toward this dynamic mean value.

4. The method of claim 3, further comprising simultaneous measurement, for each of the refrigerators/liquefiers, of the differential in temperature of the working gas between the return flow and the outbound flow at the same temperature level in the cold box, and in that control of each bypass valve is corrected as a function of the discrepancy between said differential in temperature for the refrigerator/liquefier concerned and the mean of said temperature differential calculated for all of the refrigerators/liquefiers, the opening/closing of each bypass valve being reduced when the temperature differential for the refrigerator/liquefier concerned increases in terms of absolute value with respect to the mean of said temperature differential.

5. The method of claim 1, wherein at the outlet of the compression station, each refrigerator/liquefier comprises a variable-opening controlled outlet valve, the method comprising simultaneous measurement, for each of the refrigerators/liquefiers, of the operating parameter consisting of the instantaneous value of the flow rate of the outlet flow of working gas, the method comprising a step of real-time calculation of the dynamic mean value of the operating parameter for all the refrigerators/liquefiers, the apparatus performing real-time control of the opening/closing of each outlet valve as a function of the difference between the instantaneous values of the operating parameter of the refrigerator/liquefier concerned so as to cause said instantaneous values of said operating parameter of the various refrigerators/liquefiers to converge toward this dynamic mean value.

6. The method of claim 5, wherein each outlet valve is controlled according to a pressure set point measured at the outlet of said valve, the apparatus performing real-time control of the opening/closing of each outlet valve so as to reduce the pressure set point when the instantaneous value of the flow rate of the flow of gas at the outlet of the compression station of the refrigerator/liquefier concerned is greater than said dynamic mean value, and vice versa.

7. The method of claim 1, wherein the secondary pipe is provided with a variable-opening distribution valve the opening of which is increased in the event of an increased production of liquefied working gas in the cold box, in that control of each downstream valve is corrected as a function of the state of opening of the distribution valve so as to reduce the opening of the downstream valve when the opening of the distribution valve increases, and vice versa.

8. The method of claim 1, wherein the cold box of each refrigerator/liquefier comprises a plurality of heat exchangers for cooling the working fluid and a bypass pipe for bypassing at least some of said exchangers supplying working gas at the outlet of the cold box, said bypass pipe being connected to the rest of the working circuit in a heat exchange relationship with the exchangers via variable-opening respective controlled bypass valves, the method comprising simultaneous measurement, for each of the refrigerators/liquefiers, of the operating parameter consisting of the instantaneous value of the flow rate of the flow of gas in said bypass pipe, the method comprising a step of real-time calculation of the dynamic mean value of this operating parameter for all of the refrigerators/liquefiers, the apparatus performing real-time control of the opening/closing of at least one of the bypass valves as a function of the difference between the instantaneous values and the dynamic mean value of this operating parameter of the refrigerator/liquefier concerned, so as to cause said instantaneous values of said operating parameter of the various refrigerators/liquefiers to converge toward this dynamic mean value.

9. The method of claim 1, wherein the working circuit comprises, inside the cold box of each refrigerator/liquefier, a plurality of exchangers for warming up the cold working fluid that has exchanged heat with the application, the working circuit comprising a pipe for returning the return flow of working gas returning to the compression station, the return pipe comprising a portion that is subdivided into two parallel branches referred to respectively as the "hot" leg and as the "cold" leg, the hot leg bypassing at least some of the warming up exchangers, the cold leg being thermally coupled to the warming up exchangers, the working fluid having exchanged heat with the application returning to the compression station being distributed through the hot leg when the temperature is above a determined threshold or the cold leg when the temperature is below the determined threshold, each hot leg comprising a variable-opening controlled regulating valve, the method comprising a simultaneous measurement for each of the refrigerators/liquefiers, of the operating parameter that consists of the instantaneous value of the flow rate of the flow of gas in said hot leg, the method comprising a step of real-time calculation of the dynamic mean value of this operating parameter for all the refrigerators/liquefiers, the apparatus performing real-time control of the opening/closing of the valve of the hot leg as a function of the difference between the instantaneous values and the dynamic mean value of this operating parameter of the refrigerator/liquefier concerned, so as to cause said instantaneous values of said operating parameter of the various refrigerators/liquefiers to converge toward this dynamic mean value.

10. The method of claim 9, wherein each cold leg comprises a variable-opening controlled regulating valve, the method comprising simultaneous measurement, for each of the refrigerators/liquefiers, of the operating parameter consisting of the instantaneous value of the flow rate of the flow of gas in said cold leg, the method comprising a step of real-time calculation of the dynamic mean value of this operating parameter for all the refrigerators/liquefiers, the apparatus performing real-time control of the opening/closing of the valve of the cold leg as a function of the difference between the instantaneous values and the dynamic mean value of this operating parameter for the refrigerator/liquefier concerned, so as to cause said instantaneous values of said operating parameter of the various refrigerators/liquefiers to converge toward this dynamic mean value.

* * * * *